US008276437B2

(12) United States Patent
Kitazawa

(10) Patent No.: US 8,276,437 B2
(45) Date of Patent: Oct. 2, 2012

(54) CLOGGING DETERMINING DEVICE FOR REDUCING AGENT INJECTION VALVE AND CLOGGING DETERMINING METHOD FOR REDUCING AGENT INJECTION VALVE

(75) Inventor: Eiichi Kitazawa, Saitama (JP)

(73) Assignee: Bosch Corporation, Tokyo (JP)

( * ) Notice: Subject to any disclaimer, the term of this patent is extended or adjusted under 35 U.S.C. 154(b) by 697 days.

(21) Appl. No.: 12/523,752

(22) PCT Filed: Jan. 17, 2008

(86) PCT No.: PCT/JP2008/050508

§ 371 (c)(1),
(2), (4) Date: Jul. 20, 2009

(87) PCT Pub. No.: WO2008/090798

PCT Pub. Date: Jul. 31, 2008

(65) Prior Publication Data

US 2010/0005871 A1 Jan. 14, 2010

(30) Foreign Application Priority Data

Jan. 26, 2007 (JP) ..... 2007-015942

(51) Int. Cl.
*G01M 15/10* (2006.01)

(52) U.S. Cl. ..... 73/114.69; 60/295

(58) Field of Classification Search ..... 73/114.69; 60/295

See application file for complete search history.

(56) References Cited

U.S. PATENT DOCUMENTS

| | | | | |
|---|---|---|---|---|
| 6,470,673 | B1 * | 10/2002 | van Nieuwstadt et al. | 60/274 |
| 7,971,426 | B2 * | 7/2011 | Van Nieuwstadt | 60/277 |
| 8,132,405 | B2 * | 3/2012 | Katou et al. | 60/301 |
| 8,161,735 | B2 * | 4/2012 | Kitazawa | 60/295 |
| 8,176,726 | B2 * | 5/2012 | Gerlach | 60/277 |
| 2006/0086084 | A1 * | 4/2006 | Gerlach | 60/286 |
| 2011/0000196 | A1 * | 1/2011 | Kasahara | 60/286 |
| 2011/0099983 | A1 * | 5/2011 | Ohno | 60/277 |
| 2011/0107742 | A1 * | 5/2011 | Igarashi et al. | 60/277 |

FOREIGN PATENT DOCUMENTS

| | | | |
|---|---|---|---|
| JP | 2002129945 | A | 5/2002 |
| JP | 2002147223 | A | 5/2002 |
| JP | 2002213231 | A | 7/2002 |
| JP | 2002242663 | A | 8/2002 |
| JP | 2006274856 | A | 10/2006 |

* cited by examiner

*Primary Examiner* — Freddie Kirkland, III
(74) *Attorney, Agent, or Firm* — Michael Best & Friedrich LLP

(57) ABSTRACT

Provided is a clogging determining device and a clogging determining method for a reducing agent injection valve, which enable clogging of the reducing agent injection valve to be determined with high precision in further consideration of the individual difference of the system. There are provided an opened-valve pressure reduction amount calculating element for calculating an opened-valve pressure reduction amount representing a pressure reduction amount in the supply passage which is reduced in a predetermined time when the pressure-feeding operation of the pump is stopped under the state that the reducing agent injection valve is set to an injection mode, a closed-valve pressure reduction amount calculating element for calculating a closed-valve pressure reduction amount representing the pressure reduction amount in the supply passage which is reduced in a predetermined time when the pressure-feeding operation of the pump is stopped under the state that the reducing agent injection valve is set to a full-close mode; and a clogging determining element for comparing the opened-valve pressure reduction amount with the closed-valve pressure reduction amount to determine clogging of the reducing agent injection valve.

12 Claims, 9 Drawing Sheets

CLOGGING DETERMINING DEVICE FOR REDUCING AGENT INJECTION VALVE AND CLOGGING DETERMINING METHOD FOR REDUCING AGENT INJECTION VALVE

TECHNICAL FIELD

The present invention relates to a clogging determining device for a reducing agent injection valve and a clogging determining method for a reducing agent injection valve which are used in an exhaust gas purification system. Particularly, the invention relates to a clogging determining device for a reducing agent injection valve and a clogging determining method for a reducing agent injection valve which enable clogging determination taking a variation in individual difference of the system into consideration.

BACKGROUND ART

Particulate matter (hereinafter referred to as PM), nitrogen oxide (hereinafter referred to as $NO_x$), etc. which may induce a risk of affecting the environment are contained in exhaust gas discharged from an internal combustion engine such as a diesel engine or the like. An exhaust gas purification system (Selective Catalytic Reduction (SCR) system) for injecting and mixing reducing agent such as urea solution, hydro carbon (HC) or the like into exhaust gas and selectively reducing and purifying $NO_x$ with catalyst is known as an exhaust gas purification system used to purify $NO_x$.

An injection type for directly spraying liquid reducing agent into an exhaust gas passage through a reducing agent injection valve is known as an embodiment of a reducing agent supply device in the SCR system.

Here, in the urea solution out of the reducing agent materials described above, urea is easily crystallized in a predetermined temperature area, which causes clogging of the reducing agent injection valve. Foreign materials such as PM, etc. are frequently contained in exhaust gas irrespective of the kind of the reducing agent, and these foreign materials may invade into a nozzle or a reducing agent injection valve and induce seizing or the like, so that clogging occurs in the reducing agent injection valve.

Therefore, there has been proposed a method of determining a clogging of a reducing agent injection valve in an injection type reducing agent supply device by detecting the pressure of a supply passage for reducing agent. More specifically, there has been disclosed a method of determining by a pressure sensor 324 disposed in a reducing agent supply passage 321 whether a pressure reduction amount due to injection of reducing agent is normal or not and then determining clogging of a reducing agent adding valve (reducing agent injection valve) 320 when the pressure reduction amount is not normal as shown in FIG. 9 in an exhaust gas purification system having an injection type reducing agent supply device. As a specific example of the method, there has been disclosed a method of referring to a map which is obtained in advance by experimentally determining the correlation between the pressure reduction amount and the injection amount under a normal state, and comparing a normal value of the pressure reduction amount obtained from this map with a value obtained from the pressure sensor to determine abnormality of the pressure reduction amount (see Patent Document 1).

patent Document 1: JP-A-2006-274856 (Scope of Claim for patent paragraph [0016])

DISCLOSURE OF THE INVENTION

Problem to be Solved by the Invention

However, the clogging determining method disclosed in the patent document 1 does not consider any dispersion caused by individual difference of the overall system, and uniformly compares the experimentally obtained pressure reduction amount under the normal state with the value obtained from the pressure sensor. In order to make the determination according to the above method, it is necessary to set a large pressure reduction amount serving as a reference for determining clogging of the reducing agent adding valve. Therefore, there is a risk that clogging cannot be accurately determined in spite of occurrence of clogging.

That is, each reducing agent supply device has its own dispersion in injection control due to the dimensional precision of parts constituting itself, the response state of a sensor or the like, etc. Accordingly, even when there occurs some difference among the pressure reduction amounts detected by the pressure sensors, it is not determined whether the difference is caused by the clogging degree of the reducing agent injection valve or the individual difference of the overall system, and thus there is a risk that it is impossible to execute an accurate clogging determination.

Therefore, in determining a clogging of a reducing agent injection valve the inventors of this invention has exerted an enthusiastic effort, and found that such a problem can be solved by comparing the pressure reduction amount of a system having a reducing agent injection valve suspected to be clogged with the pressure reduction amount when the reducing agent injection valve is daringly full-closed, whereby the present invention has been implemented.

That is, an object of the present invention is to provide a clogging determining device for a reducing agent injection valve and a clogging determining method for a reducing agent injection valve in which clogging of the reducing agent injection valve can be determined with high precision in further consideration of the individual difference of the system.

Means of Solving the Problem

According to the present invention, a clogging determining device for a reducing agent injection valve in an exhaust gas purification system having: a pump for pressure-feeding reducing agent for reducing $NO_x$ in exhaust gas discharged from an internal combustion engine; a reducing agent injection valve for supplying reducing agent pressure-fed from the pump into an exhaust gas passage; a supply passage disposed between the pump and the reducing agent injection valve; and pressure detecting means for detecting the pressure in the supply passage is characterized by comprising: opened-valve pressure reduction amount calculating means for calculating an opened-valve pressure reduction amount representing a pressure reduction amount in the supply passage which is reduced in a predetermined time from any time point of a time of the stop of pressure feed, a time when a predetermined time elapses after the stop of the pressure feed, and a time when the pressure in the supply passage reaches a predetermined value, when the pressure-feeding operation of the pump is stopped under the state that the reducing agent injection valve is set to an injection mode; closed-valve pressure reduction amount calculating means for calculating a closed-valve pressure reduction amount representing the pressure reduction amount in the supply passage which is reduced in a predetermined time from any time point of a time of the stop of pressure feed, a time when a predetermined time elapses after the stop of the pressure feed, and a time when the pressure in the supply passage reaches a predetermined value, when the pressure-feeding operation of the pump is stopped under the state that the reducing agent injection valve is set to a full-close mode; and clogging determining means for comparing the opened-valve pressure reduction amount with the closed-valve pressure reduction amount to determine clogging of the reducing agent injection valve, whereby the above problem can be solved.

In the construction of the clogging determining device of the reducing agent injection valve of the present invention, it is preferable that the opened-valve pressure reduction amount calculating means and the closed-valve pressure reduction amount calculating means determine the opened-valve pressure reduction amount or the closed-valve pressure reduction amount when the pressure-feeding operation of the pump is stopped from the state that the pump is operated so that the pressure value in the supply passage is kept to a predetermined value.

In the construction of the clogging determining device for the reducing agent injection valve of the present invention, the exhaust gas purification system has injection amount indicating means for indicating an injection amount of reducing agent to be injected from the reducing agent injection valve, and it is preferable that the predetermined time when the opened-valve pressure reduction amount and the closed-valve pressure reduction amount are determined by the opened-valve pressure reduction amount calculating means and the closed-valve pressure reduction amount calculating means is determined in accordance with an injection amount of the reducing agent which is indicated by the injection amount indicating means.

Furthermore, in the construction of the clogging determining device for the reducing agent injection valve of this invention, it is preferable that the clogging determining means determines the clogging of the reducing agent injection valve by comparing the difference between the opened-valve pressure reduction amount and the closed-valve pressure reduction amount with a predetermined clogging determining reference value.

Furthermore, according to another aspect of the present invention, a clogging determining method for a reducing agent injection valve in an exhaust gas purification system having: a pump for pressure-feeding reducing agent for reducing $NO_x$ in exhaust gas discharged from an internal combustion engine; a reducing agent injection valve for supplying reducing agent pressure-fed from the pump into an exhaust gas passage; a supply passage disposed between the pump and the reducing agent injection valve; and pressure detecting means for detecting the pressure in the supply passage is characterized in that an opened-valve pressure reduction amount representing a pressure reduction amount in the supply passage which is reduced in a predetermined time from any time point of a time of the stop of pressure feed, a time when a predetermined time elapses after the stop of the pressure feed, and a time when the pressure in the supply passage reaches a predetermined valve, when a pressure-feeding operation of the pump is stopped under a state that the reducing agent injection valve is set to an injection mode is compared with a closed-valve pressure reduction amount representing a pressure reduction amount in the supply passage which is reduced in a predetermined time from any time point of a time of the stop of pressure feed, a time when a predetermined time elapses after the stop of the pressure feed, and a time when the pressure in the supply passage reaches a predetermined value, when the pressure-feeding operation of the pump is stopped under a state that the reducing agent injection valve is set to a full-close mode, thereby determining whether the redundant injection valve is clogged or not.

In order to implement the clogging determining method for the reducing agent injection valve of the present invention, it is preferable that the clogging determining method comprises: a step of pressure-feeding reducing agent by a pump so that a pressure value in the supply passage is kept to a predetermined value; a step of stopping the pressure-feeding operation of the pump under the state that the reducing agent injection valve is set to the injection mode and determining the opened-valve pressure reduction amount; a step of restarting the pressure-feeding operation of the pump, stopping the pressure-feeding of the pump under the state that the reducing agent injection valve is set to the full-close mode after the pressure value in the supply passage reaches a predetermined value, and determining the closed-valve pressure reduction amount; and a step of comparing the difference between the opened-valve pressure reduction amount and the closed-valve pressure reduction amount with a clogging determining reference value to determine whether the reducing agent injection valve is clogged or not.

In order to implement the clogging determining method for the reducing agent injection valve of the present invention, it is preferable that the opened-valve pressure reduction amount is periodically determined under a normal operation state of an internal combustion engine, the opened-valve pressure reduction amount concerned is compared with a predetermined test start reference value, and the closed-valve pressure reduction amount is determined when the opened-valve pressure reduction amount is smaller than the test start reference value.

In order to implement the clogging determining method for the reducing agent injection valve of the present invention, it is preferable that the step of determining the opened-valve pressure reduction amount and comparing the opened-valve pressure reduction amount with the test start reference value is executed at plural times, and the closed-valve pressure reduction amount is determined when the opened-valve pressure reduction amount is smaller than the test start reference value sequentially at plural times.

Effect of the Invention

According to the clogging determining device for the reducing agent injection valve of the present invention, it is provided with the predetermined opened-valve pressure reduction amount calculating means, the predetermined closed-valve pressure reduction amount calculating means and the clogging determining means for comparing them to execute the clogging determination, whereby the pressure variation amount caused by the individual difference of the system of the reducing agent supply device itself is offset, and an abnormal state of the pressure variation caused by only the clogging of the reducing agent injection valve can be detected. Accordingly, the clogging determination of the reducing agent injection valve can be performed with high precision, and maintenance of the reducing agent injection valve can be properly performed, or the injection control of the reducing agent can be efficiently performed.

Furthermore, in the clogging determining device for the reducing agent injection valve of the present invention, the pressure-feeding operation of the pump is stopped under the state that the pressure value of the reducing agent at the downstream side of the pump is kept to a predetermined value, and the respective pressure reduction amounts are determined, whereby the transition of the pressure variation in the supply passage of the reducing agent can be easily compared.

Still furthermore, in the clogging determining device for the reducing agent injection valve of the present invention, the reference time for the pressure reduction amounts under the valve open state and under the valve close state is determined in accordance with the injection amount from the reducing agent injection valve when the opened-valve pressure reduction amount is determined, whereby occurrence of an error caused by reduction of the residual amount of the reducing agent in the supply passage can be suppressed, and the precision of the clogging determination can be enhanced.

In the clogging determining device for the reducing agent injection valve of the present invention, the difference between the opened-valve pressure reduction amount and the closed-valve pressure reduction amount is compared with the predetermined clogging determination reference value, whereby the clogging determination corresponding to the clogging degree of the reducing agent injection valve can be performed.

According to the clogging determining method for the reducing agent injection valve of the present invention, the pressure reduction amount in the injection mode of the reducing agent injection valve is compared with the pressure reduction amount in the full-close mode, whereby the pressure variation amount caused by the individual difference of the system of the reducing agent supply device itself can be offset. Accordingly, the abnormal state of the pressure variation caused by only the clogging of the reducing agent injection valve can be detected, and the clogging determination of the reducing agent injection valve can be performed with high precision.

Still furthermore, in the clogging determining method for the reducing agent injection valve of the present invention, by successively executing the predetermined steps, the opened-valve pressure reduction amount and the closed-valve pressure reduction amount of the reducing agent injection valve are calculated and then compared with each other, whereby the clogging determination for detecting the abnormal state of the pressure variation caused by only the clogging of the reducing agent injection valve can be efficiently executed.

Still furthermore, in the clogging determining method for the reducing agent injection valve of the present invention, the opened-valve pressure reduction amount is periodically determined under the normal operation state, and the mode is shifted to a test mode to determine the closed-valve pressure reduction amount only when clogging of the reducing agent injection valve is suspected, whereby the determination of the pressure reduction amount which follows a valve closing operation is not required when there is in no danger of clogging. Therefore, the clogging determination of the reducing agent injection valve can be efficiently performed without interrupting normal $No_x$ purification.

Still furthermore, in the clogging determining method for the reducing agent injection valve of the present invention, by comparing the opened-valve pressure reduction amount and the predetermined test start reference value with each other at plural times in advance, a reducing agent injection valve having a clogging risk can be grasped with high precision, and the clogging determination for the reducing agent injection valve can be more efficiently performed.

BEST MODE FOR CARRYING OUT THE INVENTION

Figure 1:
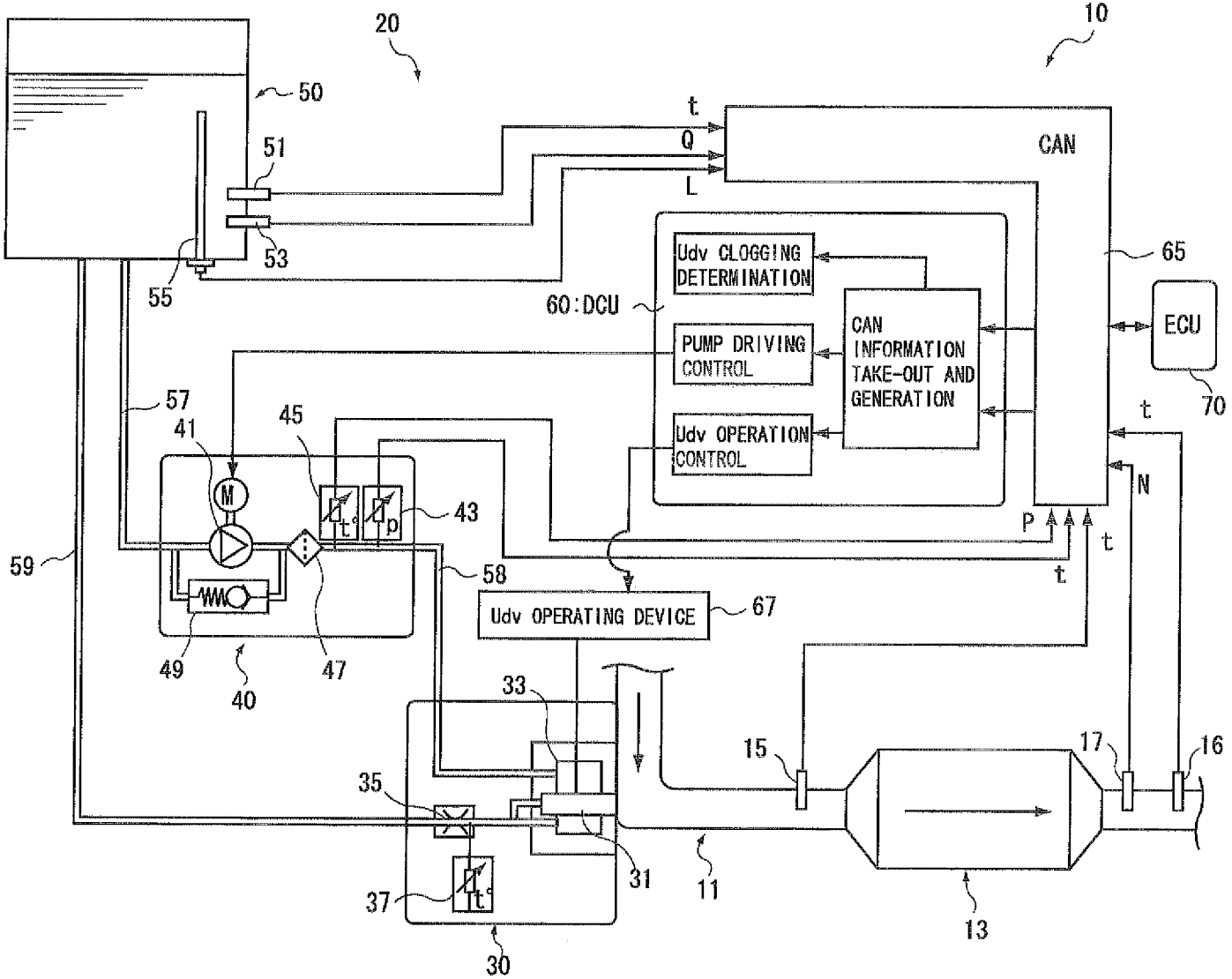
FIG. 1 is a diagram showing an example of the construction of an exhaust gas purification system according to an embodiment of the present invention.

Embodiments of a clogging determining device and a clogging determining method for a reducing agent injection valve according to the present invention will be described with reference to the accompanying drawings. These embodiments are examples of the present invention and do not limit the present invention, and thus these embodiments may be arbitrarily modified without departing from the subject matter of the present invention.

In the drawings, the same reference numerals represent the same members, and the description thereof is omitted.

1. Clogging Determining Device for Reducing Agent Injection Valve (1) Whole Construction of Exhaust Gas Purification System First, an example of the construction of an exhaust gas purification system (hereinafter referred to as "system" in some cases) having a clogging determining device for a reducing agent injection valve of this embodiment will be described with reference to FIG. 1.

The exhaust gas purification system 10 shown in FIG. 1 is an exhaust gas purification system 10 in which urea water solution is used as reducing agent and exhaust gas is passed through $NO_x$ catalyst 13 together with the reducing agent to thereby selectively reduce $NO_x$. This exhaust gas purification system 10 has a $NO_x$ catalyst 13 which is disposed at some midpoint of an exhaust gas passage 11 connected to an internal combustion engine and selectively reduces $NO_x$ contained in exhaust gas, and a reducing agent supply device 20 having a reducing agent injection valve 31 for injecting reducing agent into the exhaust gas passage 11 at the upstream side of the $NO_x$ catalyst 13. Temperature sensors 15 and 16 are disposed at the upstream side and downstream side of the $NO_x$ catalyst 13 of the exhaust gas passage 11 respectively, and an $NO_x$ sensor 17 is disposed at the downstream side of the $NO_x$ catalyst 13. The $NO_x$ catalyst 13, the temperature sensors 15 and 16 and the $NO_x$ sensor 17 are not limited to specific constructions, and well-known constructions may be used.

However, in the exhaust gas purification system of this embodiment, at least the $NO_x$ sensor 17 has its own trouble diagnosing function, and when an abnormal state is detected, error information is output to CAN (Controller Aria network) 65 described later.

The reducing agent supply device 20 has an injection module 30 having the reducing agent injection valve 31, a storage tank 50 in which reducing agent is stocked, a pump module 40 having a pump 41 for pressure-feeding the reducing agent in the storage tank 50 to the reducing agent injection valve 31, and a control unit (hereinafter referred to as "DCU: Dosing Control unit") 60 for controlling the injection module 30 and the pump module 40 to control the injection amount of the reducing agent to be injected from the reducing agent injection valve 31. The storage tank 50 and the pump module 40 are connected to each other through a first supply passage 57, the pump module 40 and the injection module 30 are connected to each other through a second supply passage 58, and the injection module 30 and the storage tank 50 are connected to each other through a circulating passage 59.

Furthermore, in the example of the exhaust gas purification system 10 shown in FIG. 1, DCU 60 is connected to CAN 65. A control unit (hereinafter referred to as "ECU: Engine Control Unit" in some cases) 70 for controlling the operation state of the internal combustion engine is connected to CAN 65. Not only information concerning the operation state of the internal combustion engine such as the fuel injection amount, the injection timing, the rotational number, etc. are written into DCU 60, but also information of all the sensors, etc. provided to the exhaust gas purification system 10 is written into DCU 60. Furthermore, In Can 65, it can be determined whether an input signal value is within a standard range of CAN 65 or not. DCU 60 connected to CAN 65 can read information on CAN 65 and output information onto CAN 65.

In this embodiment, ECU 70 and DCU 60 comprise separate control units, and information transmission/reception therebetween can be performed through CAN 65. However, ECU 70 and DCU 60 may be constructed as one control unit.

The storage tank 50 is provided with a temperature sensor 51 for detecting the temperature of reducing agent in the tank, a level sensor 55 for detecting the residual amount of the reducing agent and a quality sensor 53 for detecting the quality such as the viscosity, concentration, etc. of the reducing agent. The values detected by these sensors are output signals and written onto CAN 60. Well-known sensors may be properly used as these sensors.

Urea water solution, hydro carbon (HC) may be mainly used as the reducing agent to be stocked. The example of the exhaust gas purification system of this embodiment relates to the construction when urea water solution is used.

Furthermore, the pump module 40 has a pump 41, a pressure sensor 43 for detecting the pressure (hereinafter referred to as "pressure of reducing agent" in some cases) of the second supply passage 58 at the downstream side of the pump 41, a temperature sensor 45 for detecting the temperature of the reducing agent to be pressure-fed, a foreign material collecting filter 47 disposed at some midpoint of the second supply passage 58 at the downstream side of the pump 41, and a pressure control valve 49 for returning a part of the reducing agent from the downstream side of the pump 41 to the upstream side of the pump 41 to reduce the pressure of the reducing agent when the pressure of the reducing agent at the downstream side of the pump 41 exceeds a predetermined value.

The pump 41 comprises an electrically-operated pump, for example, and it is operated on the basis of a signal transmitted from DCU 60. Well-known members may be used as the pressure sensor 43 and the temperature sensor 45. The values detected by these sensors are output as signals and written onto CAN 60. Furthermore, a well-known check valve or the like may be used as the pressure control valve 49, for example.

Furthermore, the injection module 30 has a pressure chamber 33 in which reducing agent pressure-fed from the pump module 40 side is stocked, the reducing agent injection valve 31 connected to the pressure chamber 33, an orifice 35 disposed at some midpoint of a passage intercommunicating with the circulating passage 59 from the pressure chamber 33, and a temperature sensor 37 disposed just before the orifice 35.

The reducing agent injection valve 31 comprises an ON-OFF valve in which ON-OFF of valve opening is controlled by duty control, for example. The reducing agent which is pressure-fed from the pump module 40 is stocked under a predetermined pressure in the stock chamber 33, and the reducing agent is injected into the exhaust gas passage 11 when the reducing agent injection valve 31 is opened on the basis of a control signal transmitted from DCU 60. The orifice 35 is disposed in the passage at the downstream side of the pressure chamber 33, whereby the internal pressure of each of the pressure chamber 33 and the second supply passage 58 at the upstream side of the orifice 35 is hardly reduced, and thus the output of the pump module 40 can be suppressed to a low value. In place of the orifice 45, a valve for controlling the circulation of the reducing agent may be provided at some midpoint of the circulation passage 59.

The circulation passage 59 disposed between the injection module 30 and the storage tank 50 is provided for reflowing the reducing agent into the storage tank 50 so that reducing agent other than reducing agent injected from the reducing agent injection valve 31 of the injection module 30 out of the reducing agent pressure-fed by the pump module 40 is prevented from being affected by exhaust gas heat or the like and suffering high temperature.

DCU 60 can control the operation of the reducing agent injection valve 31 on the basis of various information existing on CAN 65 so that a proper amount of reducing agent is injected into the exhaust gas passage 11. Furthermore, DCU 60 of this embodiment has also a function as the clogging determining device for the reducing agent injection valve 31 (hereinafter referred to as "clogging determining device' in some cases).

DCU 60 mainly comprises a microcomputer having a well-known construction, and FIG. 1 shows an example of the construction represented by functional blocks with respect to parts concerning the control of the operation of the reducing agent injection valve 31, the control of the driving of the pump 41 and the clogging determination of the reducing agent injection valve 31.

That is, DCU 60 of this embodiment of the present invention comprises a CAN information taking and generating unit (represented as "CAN information take-out and generation" in FIG. 1), a reducing agent injection valve clogging determining unit (represented as "Udv clogging determination" in FIG. 1), a pump driving controller (represented as "pump driving control" in FIG. 1), a reducing agent injection valve operation controller (represented as "Udv operation control" in FIG. 1), RAM (Random Access Memory), etc. as main constituent elements. These parts are specifically implemented by executing programs in a microcomputer (not shown).

The CAN information taking and generating unit reads information existing on CAN 65, which contains information concerning the pressure of the reducing agent in the second supply passage, and outputs the information to each part.

Furthermore, the pump driving controller continually reads information concerning the pressure of reducing agent in the second supply passage 58 which is output from the CAN information generator, and subjects the pump 41 to feedback control on the basis of this pressure information, whereby the pressure of the reducing agent in the second supply passage 58 and the pressure chamber 33 is kept to a substantially fixed state. For example, when the pump 41 is an electrically-operated pump, the duty ratio of the electrically-operated pump 41 is controlled to increase to increase the pressure if the output pressure value is lower than a target value. Conversely, the duty ratio of the electrically-operated pump 41 is controlled to decrease to reduce the pressure if the output pressure value exceeds the target value.

The reducing agent injection valve operation controller reads the information concerning the reducing agent in the storage tank 50, the information concerning the exhaust gas temperature, the $NO_x$ catalyst temperature and the $NO_x$ concentration at the downstream side of the $NO_x$ catalyst and the information concerning the operation state of the internal combustion engine which are output from the CAN information taking and generating unit, generates a control signal for injecting from the reducing agent injection valve 31 reducing agent whose amount is set to an amount required to reduce $NO_x$ in the exhaust gas, and outputs the control signal to a reducing agent injection valve operating device 67 for operating the reducing agent injection valve 31. In the reducing agent injection valve operation controller, an injection instruction amount of the reducing agent which is indicated to the reducing agent injection valve operating device 67 (hereinafter referred to as "reducing agent injection instruction amount" in some cases) is integrated.

The reducing agent injection valve operation controller can switch the mode of the reducing agent injection valve 31 to the full-close mode in addition to the normal injection mode of the reducing agent injection valve 31. The integration of the reducing agent injection instruction amount described above is executed even under the state that the reducing agent is not actually injected in the full-close mode.

The purification of the exhaust gas by the exhaust gas purification system 10 shown in FIG. 1 is executed as follows.

During the operation of the internal combustion engine, the reducing agent in the storage tank 50 is sucked by the pump 41, and pressure-fed to the injection module 30 side. A detection value obtained by the pressure sensor 43 at the downstream side of the pump 41 provided to the pump module 40 is fed back. When the detection value is less than a predetermined value, the output of the pump 41 is increased, and when the pressure value exceeds a predetermined value, the pressure is reduced by the pressure control valve 49. Accordingly, the pressure of the reducing agent pressure-fed to the injection module 30 side is controlled to be kept to a substantially fixed value.

The reducing agent pressure-fed from the pump module 40 to the injection module 30 flows into the pressure chamber 33 of the reducing agents and the pressure thereof is kept to a substantially fixed pressure. When the reducing agent injection valve 31 is opened; the reducing agent is injected into the exhaust passage 11 at all times. On the other hand, the reducing agent reflows through the circulation passage 59 into the storage tank 50. Therefore, the reducing agent which is not injected into the exhaust passage 11 stays in the pressure chamber 33, so that the reducing agent is prevented from being exposed to a high-temperature atmosphere of exhaust gas heat.

Under the state that the reducing agent is stocked under a substantially fixed pressure value in the pressure chamber 33, DCU 60 determines the amount of reducing agent to be injected on the basis of the information on the operation state and the exhaust gas temperature of the internal combustion engine, the temperature of the $NO_x$ catalyst 13, the amount of $NO_x$ which is measured at the downstream side of the $NO_x$ catalyst 13 and passes through the $NO_x$ catalyst 13 without being reduced, etc., and generates and outputs the corresponding control signal to the reducing agent injection valve operation device 67. The duty control of the reducing agent injection valve 31 is performed by the reducing agent injection valve operation device 67, and a proper amount of reducing agent is injected into the exhaust gas passage 11. The reducing agent injected in the exhaust gas passage 11 flows into the $NO_x$ catalyst 13 while mixed in the exhaust gas, and used for reductive reaction of $NO_x$ contained in the exhaust gas. As described above, the exhaust gas is purified.

(2) Clogging Determining Device

Figure 2:
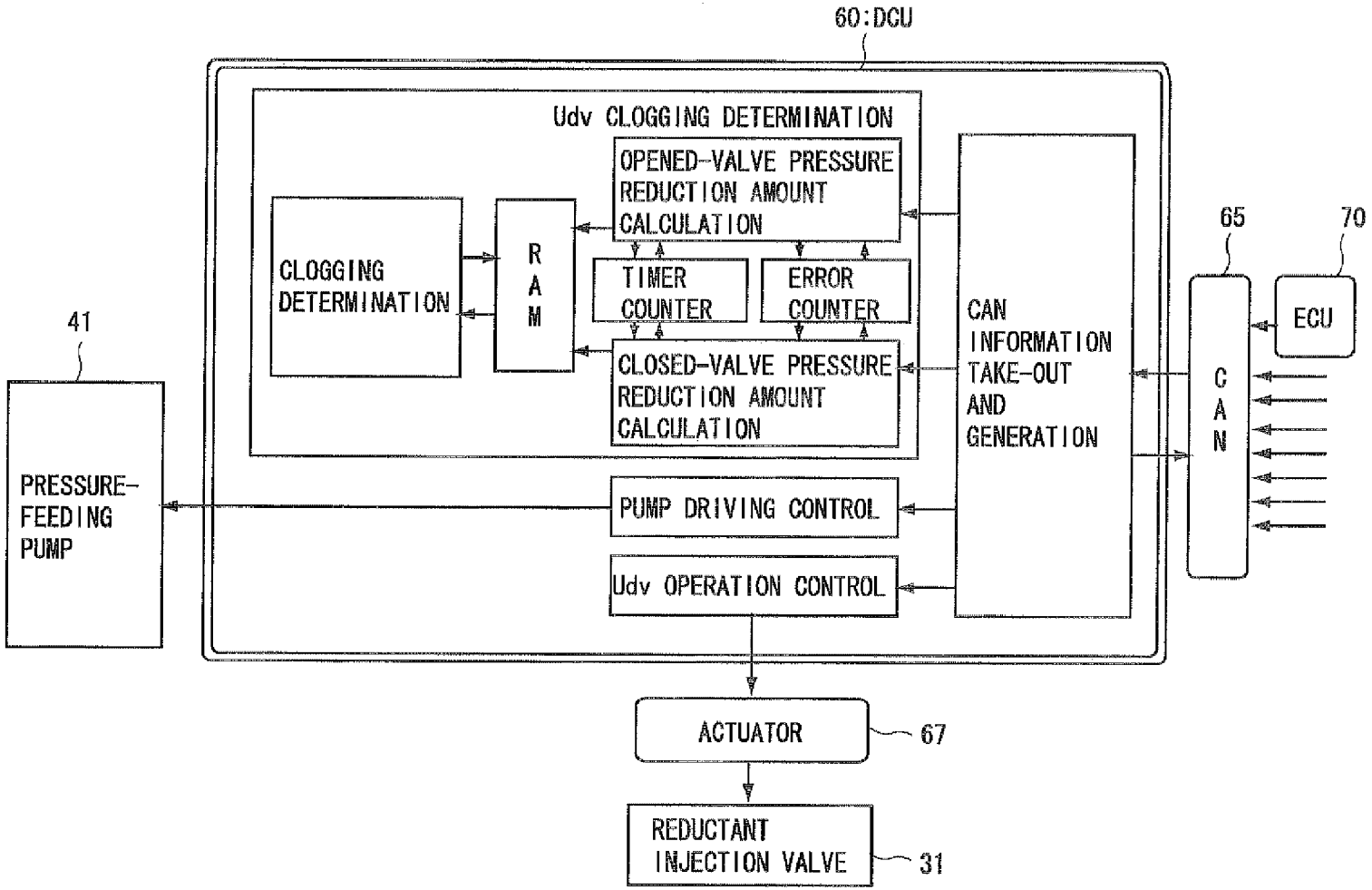
FIG. 2 is a block diagram showing an example of the construction of a clogging determining device for a reducing agent injection valve.

Here, DCU 60 of the embodiment of the present invention is provided with a reducing agent injection valve clogging determining unit (hereinafter referred to as "clogging determining unit"). The reducing agent injection valve clogging determining unit executes a predetermined calculation described later on the basis of the pressure information of the reducing agent output from the CAN information generator, and determines whether the reducing agent injection valve 31 is clogged. As shown in FIG. 2, the reducing agent injection valve clogging determining unit contains opened-valve pressure reduction amount calculating means (represented as "opened-valve pressure reduction amount calculation" in FIG. 2), closed-valve pressure reduction amount calculating means (represented as "closed-valve pressure reduction amount calculation" in FIG. 2), clogging determining means (represented as "clogging determination" in FIG. 2), a timer counter unit (represented as "timer counter" in FIG. 2) and an error counter unit (represented as "error counter" in FIG. 2).

The opened-valve pressure reduction amount calculating means provided to the clogging determining unit in DCU 60 of this embodiment calculates the difference (the opened-valve pressure reduction amount: hereinafter referred to as "Udvopn" in some cases) between the start value of the pressure when the pump is stopped under the state that the reducing agent injection valve is set to the injection mode and a predetermined condition described later is satisfied (hereinafter referred to as "StrtX" or "StrtY" in some cases) and a pressure value P detected when a predetermined time elapses.

Furthermore, the closed-valve pressure reduction amount calculating means provided to the clogging determining unit in DCU 60 of this embodiment calculates the difference (the closed-valve pressure reduction amount: hereinafter referred to as "Udvclo" in some cases) between the start value of the pressure when the pump is stopped under the state that the reducing agent injection valve is set to the full-close mode and a predetermined condition described later is satisfied (hereinafter referred to as "StrtZ" in some cases) and the pressure value P detected when the predetermined time elapses.

Still furthermore, the clogging determining means provided to the clogging determining unit in DCU 60 of this embodiment compares Udvopn with Udvclo, and determines whether the difference therebetween is equal to or less than a clogging determining reference value D, thereby determining the presence or absence of clogging of the reducing agent injection valve.

The clogging determining unit is provided with RAM, and pressure information of the reducing agent output from the CAN information generator is written and stored in RAM during a predetermined time period. Specifically, the pressure value when the driving of the pump is stopped is stored as an initial value (hereinafter referred to as "Init" in some cases), and then when the difference between Init and the detected pressure value P is equal to a predetermined value N or more, the detected pressure value is stored as a start value (StrtX, StrtY, StrtZ). Furthermore, Udvopn and Udvclo calculated in the opened-valve pressure reduction amount calculating means and the closed-valve pressure reduction amount calculating means are also stored. When Udvopn is stored in RAM, a Udvopn writing flag UdvopnF is put up.

When the reducing agent injection indication amount from the reducing agent injection valve operation controller is equal to a fixed value or more, but the pressure in the second supply passage is not reduced in accordance with the value of the reducing agent injection indication amount, any operation error in the device is estimated. Therefore, the error counter unit executes error count.

Furthermore, the timer counter unit is used to count the time when the pressure reduction amount of the reducing agent is determined, and in the example of DCU 60 of this embodiment, timers 1 to 4 can be operated.

(3) Timing Chart

Figure 3:
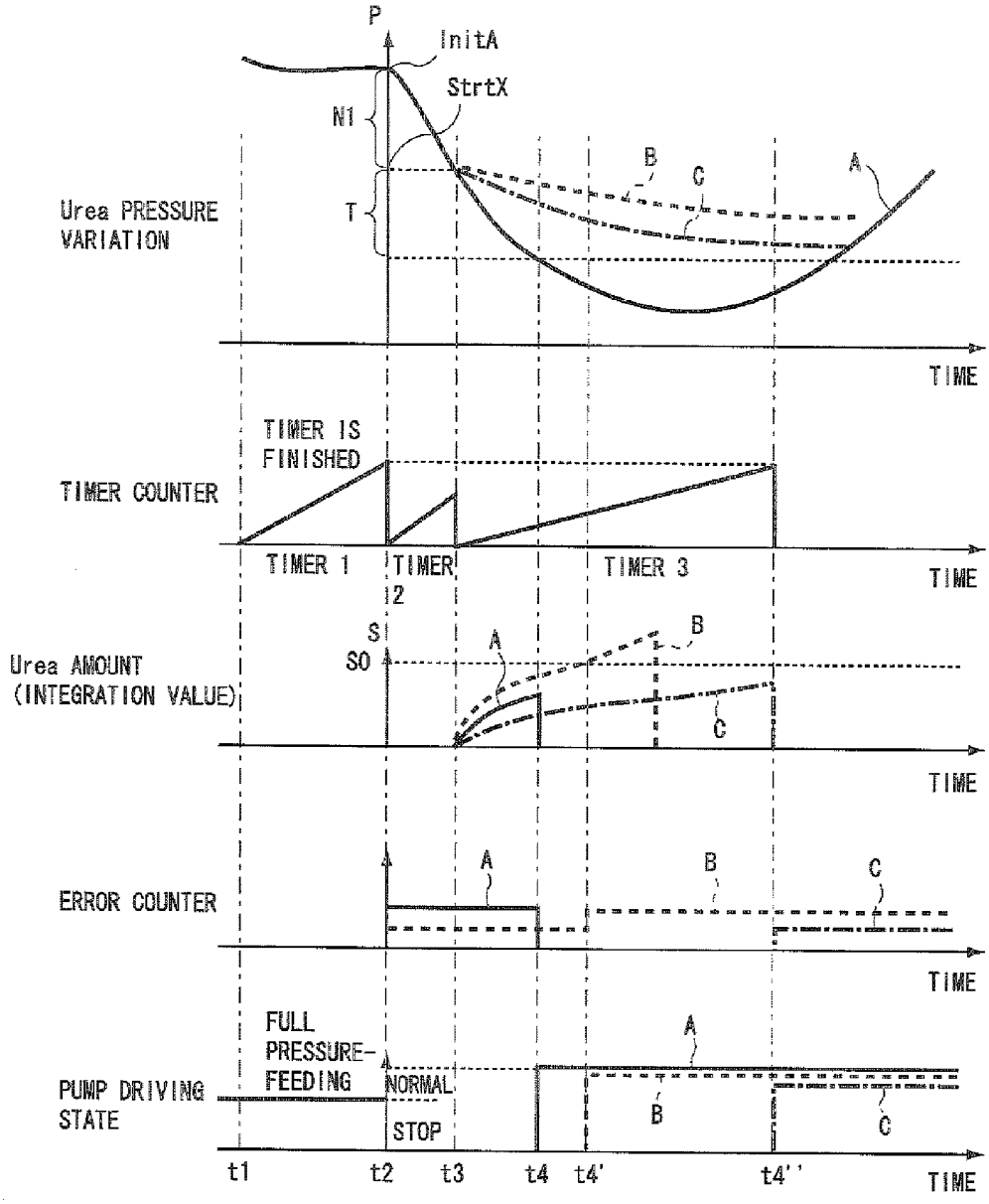
FIG. 3 is a timing chart (part 1) showing the relationship between pressure variation and clogging of the reducing agent injection valve.
Figure 4:
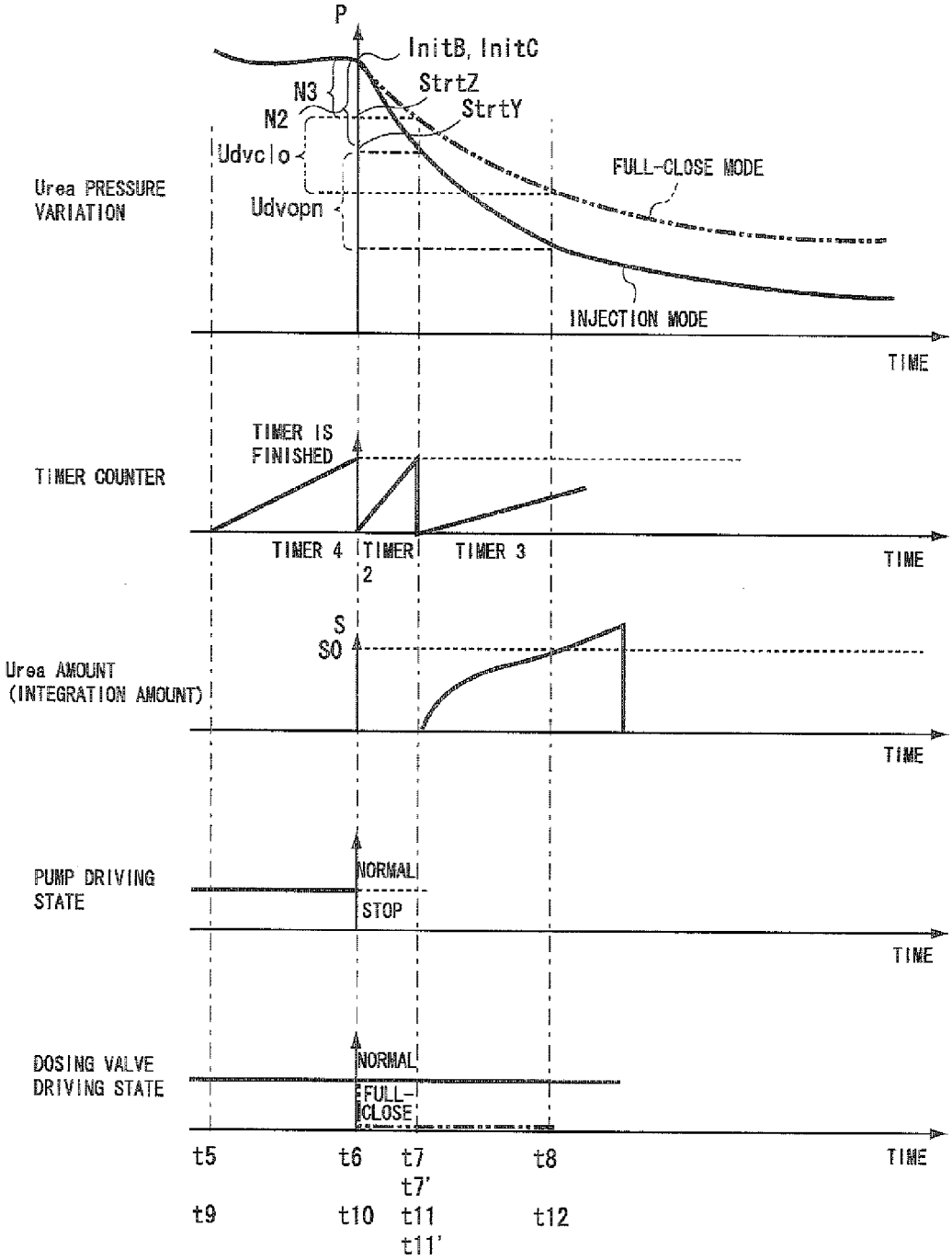
FIG. 4 is a timing chart (part 2) showing the relationship between pressure variation and clogging of the reducing agent injection valve.
Figure 5:
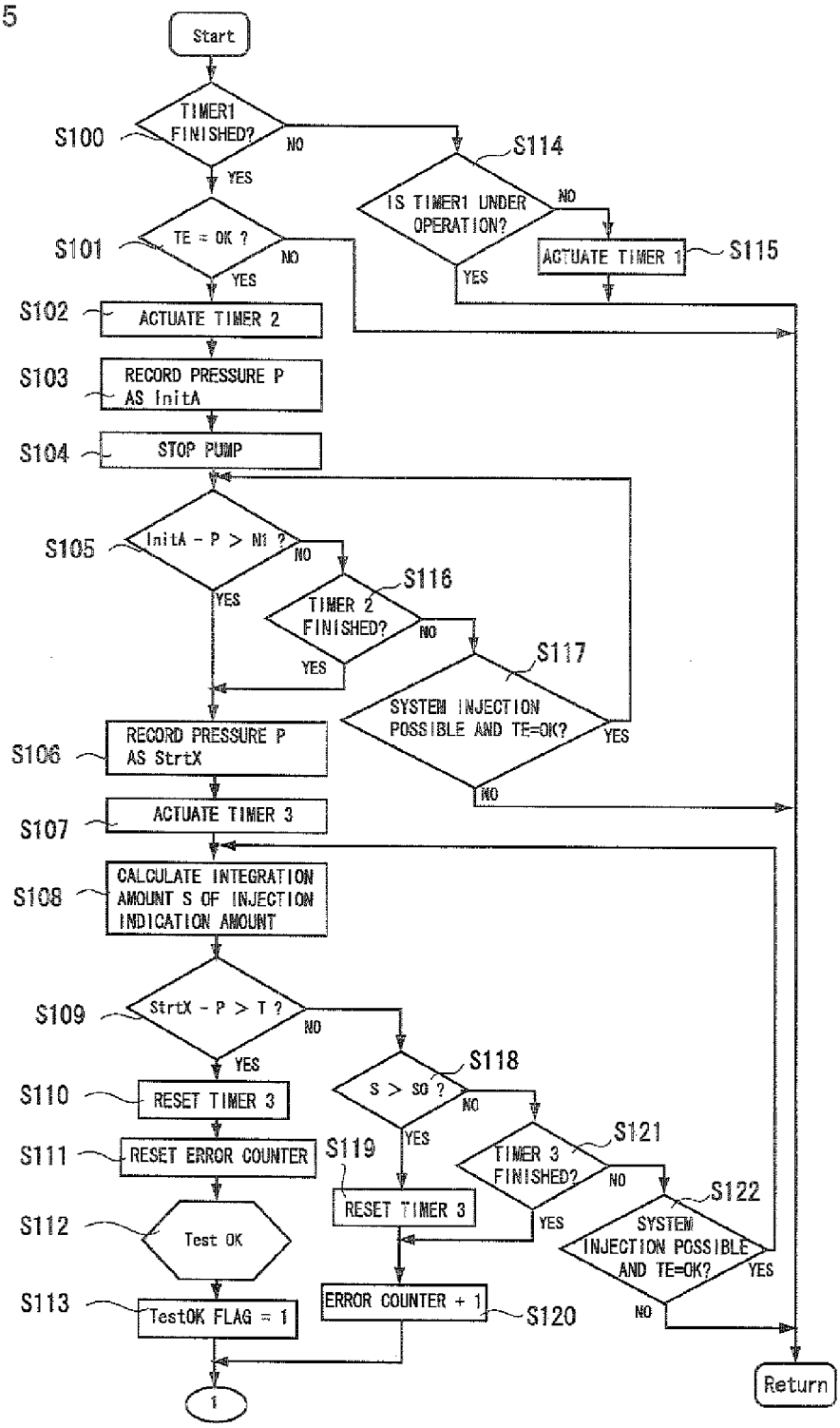
FIG. 5 is a flowchart (part 1) showing an example of a clogging determining method for the reducing agent injection valve according to an embodiment of the present invention.
Figure 6:
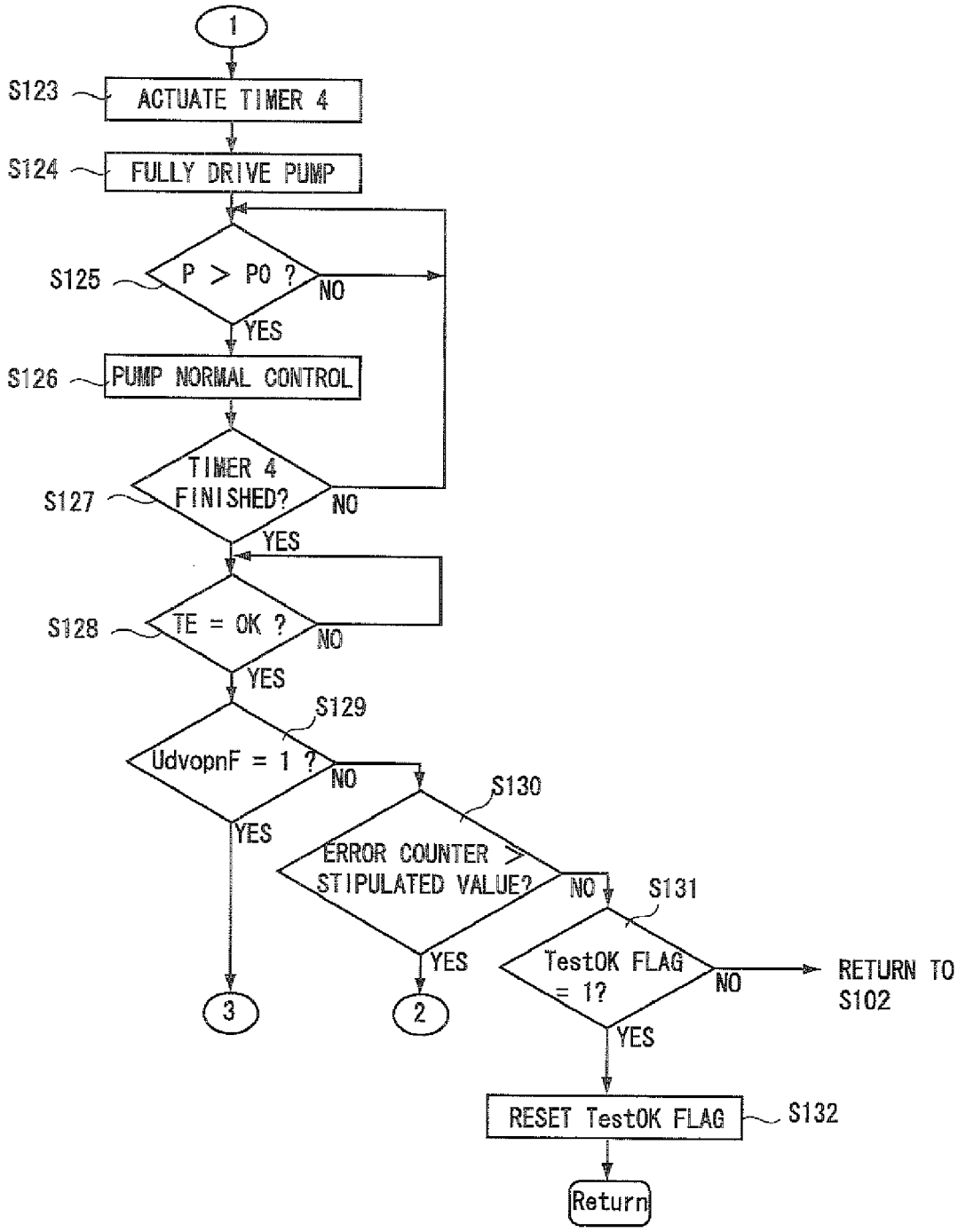
FIG. 6 is a flowchart (part 2) showing an example of the clogging determining method of the reducing agent injection valve according to the embodiment of the present invention.
Figure 7:
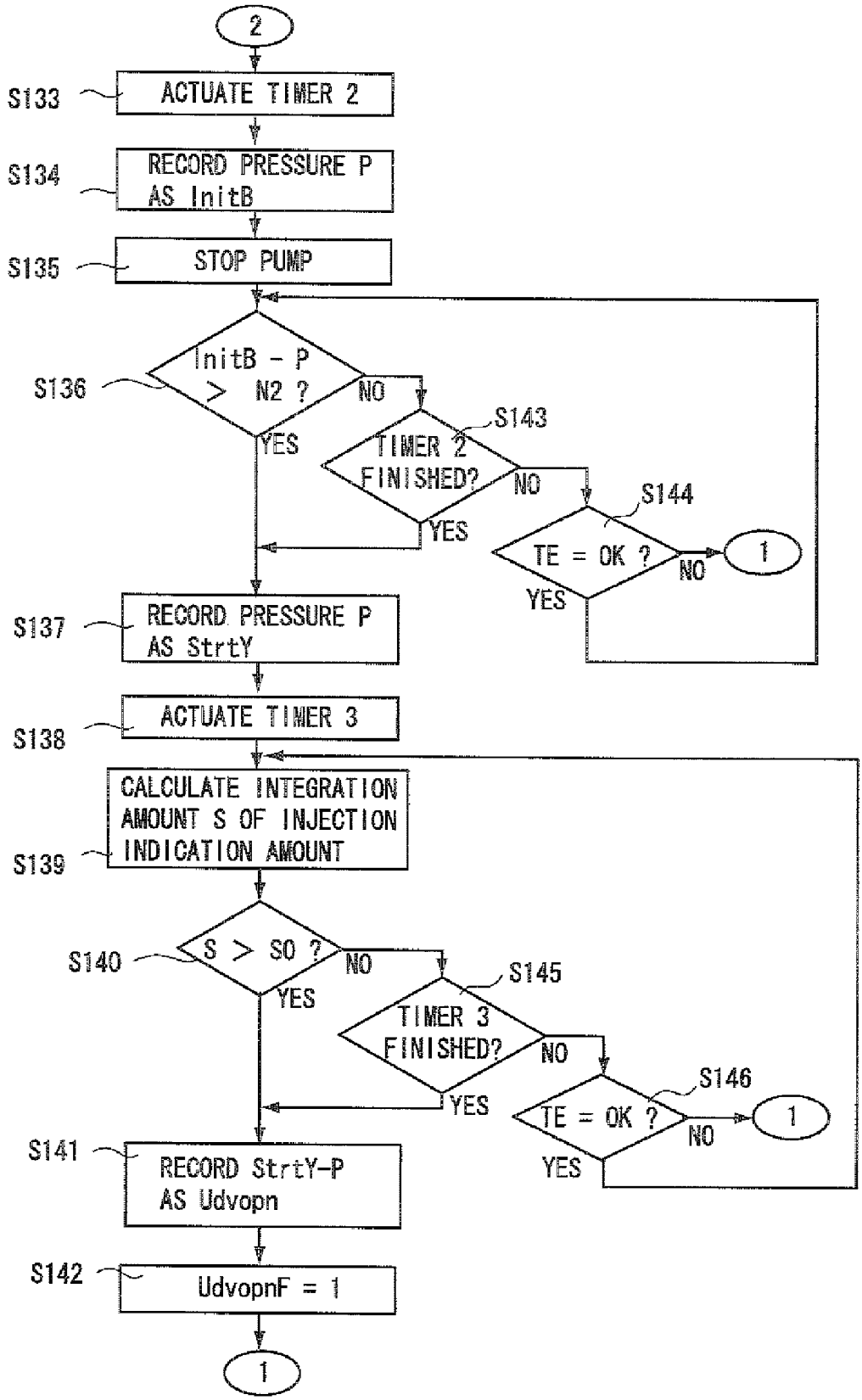
FIG. 7 is a flowchart (part 3) showing an example of the clogging determining method of the reducing agent injection valve according to the embodiment of the present invention.
Figure 8:
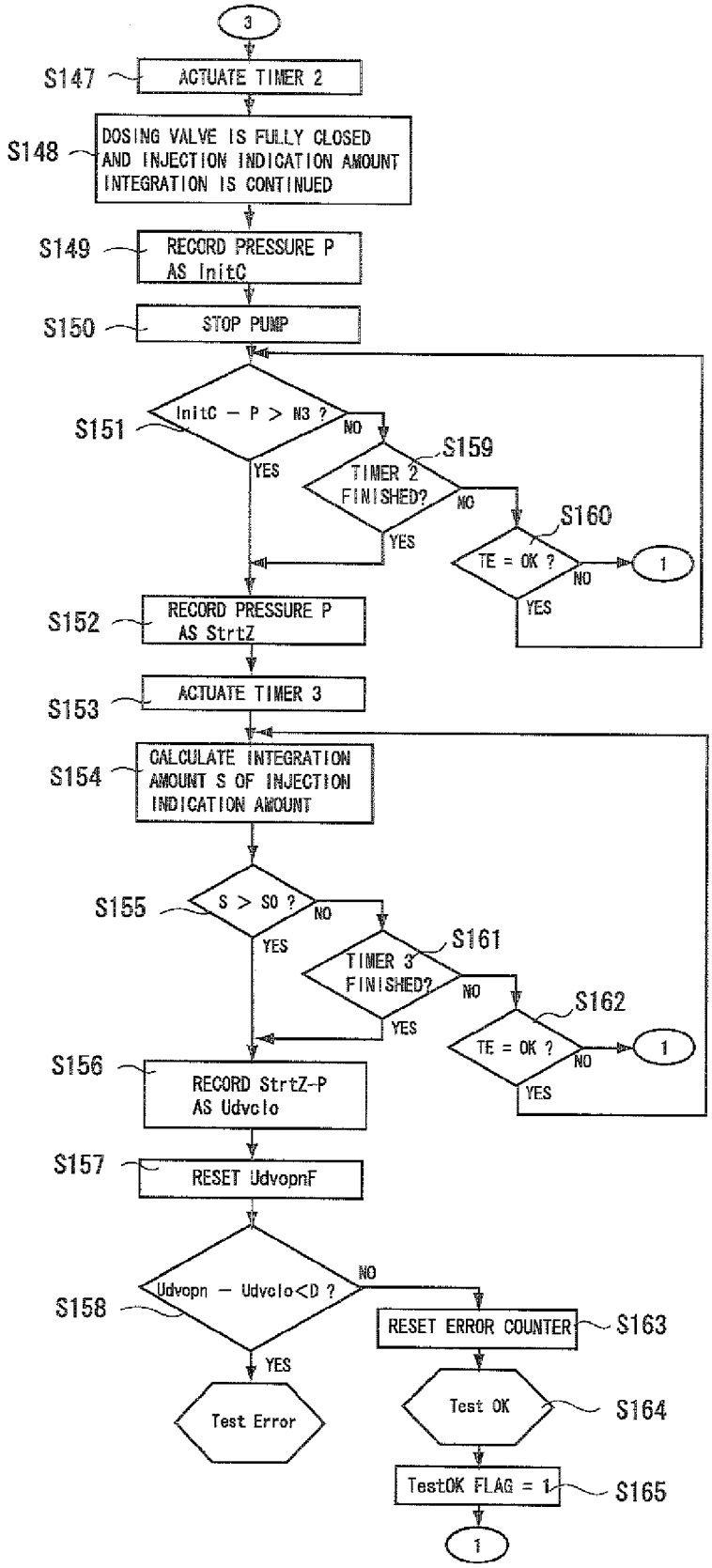
FIG. 8 is a flowchart (part 4) showing an example of the clogging determining method of the reducing agent injection valve according to the embodiment of the present invention.
Figure 9:
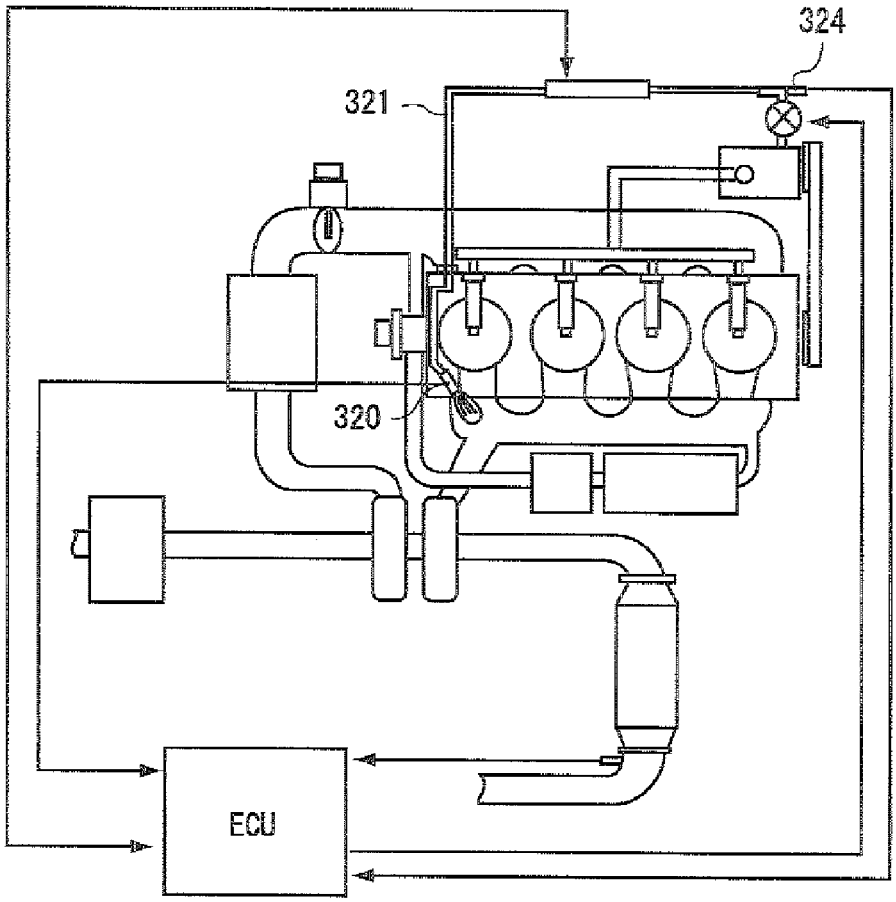
FIG. 9 is a diagram showing the construction of a conventional exhaust gas purification system.

Next, in the clogging determining device of this embodiment, the operation of comparing the opened-valve pressure reduction amount and the closed-valve pressure reduction amount and executing the clogging determination will be described in detail with reference to the timing charts of FIGS. 3 and 4. FIG. 3 is a timing chart to determine whether clogging may occur in the reducing agent injection valve, that is, the mode is required to be shifted to a determination mode, and FIG. 4 is a timing chart to compare the opened-valve pressure reduction amount and the closed-valve pressure reduction amount and execute the clogging determination of the reducing agent injection valve.

In the following timing chart, the clogging determination is executed by comparing the opened-valve pressure reduction amount and the closed-valve pressure reduction amount which are the values of the pressure reduced during the period from the time when a predetermined time elapses after the stop of the pump till the time when the integration amount of the reducing agent injection indication amount exceeds a predetermined threshold value.

As shown in FIG. 3, in the determination as to the shift to the determining mode, the timer 1 is actuated at a time point of t1 at which the reducing agent injection valve is set to the normal injection mode and the pump is set to a normal operation state. Under this state, the pressure value of the reducing agent at the downstream side of the pump is fed back to the control of the driving of the pump so that the pressure value concerned is kept to a fixed value.

When the system satisfies a test environment condition at a time point of t2 at which the timer 1 is time-out, the timer 2 is actuated. At the same timer the pressure value of the reducing agent output from CAN is stored as InitA, and the driving of the pump is stopped.

Whether the test environment condition is satisfied is determined on the basis of the determination as to whether the system is set to an injection executing mode or not, the injection indication value of the reducing agent is equal to zero or not, the value of the temperature sensor provided to the pump module is within a predetermined range or not, the pressure sensors provided to the pump, the reducing agent injection valve and the pump modules operate normally, or the like.

Subsequently to t2, under the operation of the timer 2, the pressure value P of the reducing agent output from CAN and InitA are continually compared with each other. At a time point of t3 at which the difference therebetween is equal to a predetermined value N1 or more, the timer 2 is stopped, the pressure value P of the reducing agent at that time is stored as StrtX, and also the timer 3 is actuated. At the same timer the integration of the reducing agent injection indication amount is started. The storage of StrtX is executed under the state that the pressure value P of the reducing agent is reduced by a predetermined value N1 or more in order to measure the pressure reduction amount after the pressure variation state is stabilized and thus enhance the precision of the clogging determination.

As not shown, even when the difference between the pressure value P of the reducing agent output from CAN and InitA is less than the predetermined value N1, the comparison between the pressure value P of the reducing agent and InitA is continued insofar as the system satisfies the test environment condition. As a result, even when the timer 2 is time-out, the timer 3 is actuated to start the integration of the reducing agent injection indication amount.

Subsequently to t3, under the operation of the timer 3, the pressure value P of the reducing agent output from CAN is continually compared with stored StrtX. Then, at a time point of t4, the difference therebetween is equal to a predetermined test start reference value T or more, and thus the probability that the reducing agent injection valve is clogged is estimated to be low (a pattern of a solid-line A in the figure). In this case, the timer 3 is reset and also the error counter is reset. Under this state, the pump is fully driven again and the reducing agent injection valve is returned to the normal injection mode.

In the case where the difference between the pressure value P of the reducing agent output from CAN and stored StrtX is less than the predetermined test start reference value T subsequently to t3, when the integration amount S of the reducing agent injection indication amount exceeds a predetermined threshold value S0 at a time point of t4' (a pattern of a broken line B in the figure), the pressure is not reduced by the amount matched with the reducing agent injection indication amount, and thus the probability that the reducing agent injection valve is clogged is estimated to be high. In this case, the timer 3 is reset, and also the error counter is counted.

Furthermore, subsequently to t3, even when the integration amount S of the reducing agent injection indication amount does not exceed a predetermined threshold value S0, it would be determined that the system does not satisfy the test environment condition if the timer 3 is time-out at a time point of t4" (a pattern indicated by a one-dotted chain line C in the figure), and thus the error counter is counted.

When it is determined that the probability that the reducing agent injection valve is clogged is high (the pattern indicated by the broken line B in the figure), the processing goes to a clogging determining step of FIG. 4.

On the other hand, when it is determined that the probability that the reducing agent injection valve is clogged is low (the pattern indicated by the solid line A in FIG. 3) or it is determined that the system does not satisfy the test environment condition, the calculation of the closed-valve pressure reduction amount in the full-close mode is not executed, but the steps which have been executed until now are repeated until it is determined that the probability that the reducing agent injection valve is clogged is high.

In the clogging determination shown in FIG. 4, at a time point of t5, the pressure value P of the reducing agent at the downstream side of the pump reaches a predetermined value, the pump is set to the normal driving state again, the reducing agent injection valve is set to the normal injection mode, and then the timer 4 is actuated. Thereafter, when the timer 4 is time-out at a time point of t6, the timer 2 is actuated, and also the pressure value P of the reducing agent output from CAN at that time is stored as InitB. Subsequently to t6, under the operation of the timer 2, the pressure value P of the reducing agent output from CAN and InitB are continually compared with each other. Under this state, the reducing agent supply device is kept to the injection mode. Thereafter, when the difference therebetween is equal to a predetermined value N2 or more at a time point of t7, the timer 2 is stopped, and the pressure value P of the reducing agent output from CAN at that time is stored as StrtY. At the same time, the integration of the reducing agent injection indication amount is started, and also the timer 3 is actuated. The storage of StrtY is executed under the state that the pressure value of P of the reducing agent is reduced by the predetermined value N2 or more because the pressure reduction amount after the pressure variation state is stabilized is measured to enhance the precision of the clogging determination as in the case of StrtX.

On the other hand, even when the difference between the pressure value P of the reducing agent and Initb is less than the predetermined value N2, the comparison between the pressure value P of the reducing agent and InitB is continued insofar as the test environment condition is satisfied. As a result, in a case where the timer 2 is time-out at a time of t7', the pressure value P of the reducing agent output from CAN at that time is also stored as StrtY, the timer 3 is actuated, and also the integration of the reducing agent injection indication amount is started.

Subsequently to t7, under the operation of the timer 3, at a time point of t8 at which the integration amount S of the reducing agent injection indication amount exceeds the predetermined threshold value S0, the difference between StrtY and the pressure value P of the reducing agent output from CAN at that time is stored as Udvopn. Udvopn is calculated on the basis of the time when the reducing agent injection indication amount exceeds the predetermined threshold value S0 because the respective pressure reduction amounts under assumed pressure-reduced states are calculated under the same condition when Udvopn and Vdvclo described later are calculated. In this case, even when Udvopn is calculated at plural times or there is an interval between the Udvopn and Udvclo calculation timings, the pressure reduction amounts under the same condition can be compared with each other.

Udvopn stored at this time reflects the clogging degree of the reducing agent injection valve and also the individual difference of each reducing agent supply device.

Subsequently, the reducing agent injection valve is closed, and then the same steps as described above are executed. That is, at a time point of t9, the reducing agent injection valve is returned to the normal injection mode, the pump is set to the normal driving state, and then the timer 4 is actuated Thereafter, when the timer 4 is time-out at a time point of t10, the timer 2 is actuated and the reducing agent injection valve is full-closed. The pressure value P of the reducing agent output from CAN is stored as InitC. Subsequently to t10, under the operation of the timer 2, the pressure value P of the reducing agent output from CAN at a time point of t11 is continually compared with InitC. When the difference therebetween is equal to a predetermined value N3 or more, the timer 2 is stopped, and the pressure value P of the reducing agent output from CAN at that time is stored as StrtZ. At the same time, the integration of the reducing agent injection indication amount is started, and the timer 3 is actuated.

Even in the case where the difference between the pressure value P of the reducing agent and InitC is less than the predetermined value N3, when the timer 2 is time-out at a time point of t11', the pressure value P of the reducing agent output from CAN at that time is also stored as StrtZ, the timer 3 starts to operate and the integration of the reducing agent injection indication amount is started.

Subsequently to t11, under the operation of the timer 3, at a time point t12 at which the integration amount S of the reducing agent injection indication amount exceeds the predetermined threshold value S0, the difference between StrtZ and the pressure value P output from CAN at that time is stored as Udvclo. Or, as not shown, even in the case where the integration amount S of the reducing agent injection indication amount does not exceed the predetermined threshold value S0, when the timer 3 is time-out, the difference between StrtZ and the pressure value P output from CAN is stored as Udvclo.

The thus-stored Udvclo is the measurement value under the state that the reducing agent injection valve is full-closed. That is, Udvclo is a value which is obtained in accordance with each individual characteristic of the whole reducing agent supply device, and it reflects the individual difference.

Udvopn and Udvclo which are obtained as described above are compared with each other, and it is determined whether the pressure reduction amount under the state that the reducing agent injection valve is set to the injection mode is approximate to the pressure reduction amount under the state that the reducing agent injection valve is set to the full-close mode, thereby determining the clogging of the reducing agent injection valve. That is, when the difference between Udvopn and Udvclo within a predetermined period is equal to a predetermined clogging determination reference value D or less, the same pressure reduction amount as the full-close mode is provided in spite of the injection mode, and thus it can be determined that the reducing agent injection valve is clogged. For example, when the difference between Udvopn and Udvclo is substantially equal to zero, it is estimated that the injection hole of the reducing agent injection valve is perfectly closed. Or, a map representing the correlation of the difference between Udvopn and Udvclo and the clogging degree of the reducing agent injection valve is provided to the clogging determining unit, whereby the clogging degree of the reducing agent injection valve can be determined with higher precision.

In the example of the timing chart shown in FIG. 3, Udvopn is calculated, and when it is less than the test start reference value T even at least once, Udvclo is calculated and compared with Udvopn. However, Udvclo may be calculated after the calculation of Udvopn and the comparison of Udvopn and the test start reference value T is executed at plural times. According to this calculation, there can be reduced a time period for which no reducing agent is injected because it is estimated due to a measurement error that the probability that the reducing agent injection valve is clogged is high.

2. Clogging Determining Method

Next, an example of the routine of the clogging determining method for the reducing agent injection valve which is based on the example of the timing chart of FIGS. 3 and 4 will be described with reference to the control flow shown in FIGS. 5 to 8. This routine may be executed at all times or may be executed by interrupting every fixed time.

First, in step S100 after the start, it is determined whether the timer 1 is finished or not. When the timer 1 is finished, the processing goes to step S10. When the timer 1 is not finished, the processing goes to step S114. In the step S114 in which the timer 1 is determined not to be finished, it is determined whether the timer 1 operates. When it is determined that the timer 1 operates, the processing is directly returned to the start position. On the other hand, when it is determined that the timer 1 does not operate, the processing goes to step S115 to actuate the timer 1, and then the processing is returned to the start position to repeat the processing until it is determined that the timer 1 is finished in the step S100.

In the step S101 executed when it is determined that the timer 1 is finished, it is determined whether the system satisfies the test environment condition TE. When it is determined that the test environment condition TE is satisfied, the processing goes to step S102. On the other hand, when it is determined that the test environment condition TE is not satisfied, the processing is returned to the start position, and the steps S100 to S101 are repeated until the test environment condition TE is satisfied.

In the step S102 executed when it is determined that the system satisfies the test environment condition TE, the timer 2 is actuated, and then the pressure value P of the reducing agent detected by the pressure sensor in step S103 is stored as InitA. Subsequently, the pump is stopped in step S104, and the reducing agent injection valve is opened. Thereafter, in step S105, the pressure value P of the reducing agent detected by the pressure sensor is compared with InitA stored in step S103, and it is determined whether the difference therebetween is equal to the predetermined value N1 or more. When it is determined that the difference between the detected pressure value P and InitA is equal to the predetermined value N1 or more, the processing goes to step S106. On the other hand, when the difference concerned is less than the predetermined value N1, the processing goes to step S116 to determine whether the timer 2 is finished.

When it is determined that the timer 2 is finished, the processing goes to step S106 as in the case of the determination result indicating that the difference between the pressure value P detected in step S105 and InitA is equal to the predetermined value N1 or more. When it is determined that the timer 2 is not finished, the processing goes to step S117. In step S117, it is determined whether the system is under a reducing agent-injection possible state and the test environment condition TE is satisfied. When it is determined that both the conditions are satisfied, the processing is returned to step S105. When it is determined that both the conditions are not satisfied, the processing is returned to the start position.

In the step S106 executed when it is determined that the difference of the pressure value P is equal to the predetermined value N1 or more in step S105 or it is determined that the timer 2 is finished in step S116, the detected pressure value P of the reducing agent is stored as StrtX. Subsequently, after the timer 3 is actuated in step S107, the integration of the reducing agent injection indication amount is started in step S108 and the processing goes to step S109.

In step S109, the detected pressure value P of the reducing agent is compared with StrtX stored in step 106, and it is determined whether the difference therebetween is equal to the test start reference value T or more. When it is determined that the difference concerned is equal to the test start reference value T or more, the processing goes to step S110 to reset the timer 3, and also the error counter is reset in step S111. In this case, it is considered that the probability that clogging occurs in the reducing agent injection valve is low, Test OK is determined in step S112, a Test OK flag is put up in step S113, and the processing goes to step S123.

On the other hand, in step S118 executed when it is determined that the difference between the detected pressure value P of the reducing agent and the stored StrtX is less than the test start reference value T in the step S109, it is determined whether the integration amount S of the reducing agent injection indication amount exceeds the threshold value S0. When it is determined that it exceeds the threshold value S0, the pressure reduction amount is small although the reducing agent injection indication amount is large, so that the probability that clogging occurs in the reducing agent injection valve is high. Therefore, the processing goes to step S119 to reset the timer 3, the error counter is counted in step S120, and then the processing goes to step S123.

In step S121 executed when it is determined in step S118 that the integration amount S of the reducing agent injection indication amount does not exceed the threshold value S0, it is determined whether the timer 3 is finished or not. When it is determined that the timer 3 is finished, the pressure reduction amount is small although a predetermined time elapses, and thus the probability that clogging occurs in the reducing agent injection valve may still exist. Therefore, the processing goes to step S120 to count the error counter, and then goes to step S123.

On the other hand, when it is determined that the timer 3 is not finished, the processing goes to step S122 to determine whether the system is set to a reducing agent-injection possible state and also the test environment condition TE is satisfied. When it is determined that both the conditions are satisfied, the processing is returned to step S108. When it is determined that both the conditions are not satisfied, the processing is returned to the start position, and the processing is executed from the step S100 again.

In step S123 after the difference between the pressure value P of the reducing agent detected in step S109 and StrtX is determined to be equal to the test start reference value T or more, or the integration amount S of the reducing agent injection indication amount is determined to exceed the threshold value S0 in step S118, or it is determined in step S121 that the timer 3 is time-out, the timer 4 is actuated. Subsequently, after the pump is fully actuated in step S124, it is determined in step S125 whether the pressure value P of the reducing agent exceeds a predetermined threshold value P0. When it is determined that the pressure value P of the reducing agent exceeds the threshold value P0, the pump is returned to the normal feedback control state in step S126, and the processing goes to step S127. On the other hand, when it is determined that the pressure value P of the reducing agent does not exceed the threshold value P0 in step S125, the pump is fully driven until the pressure value P exceeds the threshold value P0.

In step S127, it is determined whether the timer 4 is finished. When it is determined that the timer 4 is finished, the processing goes to step S128. When it is determined that the timer 4 is not finished, the processing is returned to step S125. In the step S128 executed when it is determined that the timer 4 is finished, it is determined whether the system satisfies the test environment condition TE. When it is determined that the test environment condition TE is satisfied, the processing goes to step S129. When it is determined that the test environment condition TE is not satisfied, the determination step is repeated until the test environment condition TE is satisfied.

In step S129 executed when it is determined that the system satisfies the test environment condition TE, it is determined whether a flag Udvopn F representing that the value of Udvopn is stored is put up or not. When UdvopnF is put up, that is, when it is determined that the value of Udvopn has been already stored, the processing goes to step S147. On the other hand, when UdvopnF is not put up, that is, when it is determined that the value of Udvopn is not stored, the processing goes to step S130.

In step S130, it is determined whether the value of the error counter is equal to a stipulated value or more. When it is determined that the value concerned is equal to the stipulated value or more, the processing goes to step S133 to store Udvopn because it is necessary to store Udvopn in order to determine clogging of the reducing agent injection valve. On the other hand, when it is determined that the value of the error counter is less than the stipulated value, the processing goes to step S131 to determine whether the Test OK flag is put up. The stipulated value of the error counter in the step S130 may be set to 1 or any value above 2. However, when it is set to a value above 2, the processing is shifted to a clogging determination process of the step S147 and subsequent steps only when it is estimated that the probability that clogging occurs in the reducing agent injection valve is high. In such a case, it can be prevented that the reducing agent injection valve is needlessly set to the full-close mode and thus the reducing efficiency of $NO_x$ is reduced.

When the Test OK flag is determined to be put up in step S131 to which the processing is shifted when the value of the error counter is less than the stipulated value, it is hardly required to perform the clogging determination of the reducing agent injection valve. Therefore, the test OK flag is reset in step S132, and then the processing is returned to the start position. On the other hand, when it is determined that the Test OK flag is not put up, the processing is returned to step S102 to repeat the same step again.

In the step of storing Udvopn, the timer 2 is first actuated in step S133, and then the pressure of the reducing agent detected in step S134 is stored as InitB. Thereafter, the pump is stopped in step S135, and the processing goes to step S136. In step S136, it is determined whether the difference between InitB stored in step S134 and the detected pressure value P of the reducing agent is equal to the predetermined value N2 or more. When the difference concerned is determined to be equal to the predetermined value N2 or more, the processing goes to step S137. On the other hand, when it is determined that the difference concerned is less than the predetermined value N2, the processing goes to step S143 to determine whether the timer 2 is finished or not. When it is determined that the timer 2 is finished, the processing goes to step S137 as in the case of the determination result indicating that the difference between the pressure value P detected in step S136 and InitB is equal to the predetermined value N2 or more. On the other hand, when it is determined that the timer 2 is not finished, the processing goes to step S144. In step S144, it is determined whether the system satisfies the test environment condition TE. When it is determined that the system satisfies the test environment condition TE, the processing is returned to step S136. On the other hand, when the system does not satisfy the test environment condition TE, the processing is returned to step S123.

In step 137 executed when it is determined in step S136 that the difference between the detected pressure value P and InitB is equal to the predetermined value N2 or more or when it is determined in step S143 that the timer 2 is finished, the pressure value P detected at that time is stored as StrtY. Subsequently, in step S138, the timer 3 starts to operate, the integration of the reducing agent injection indication amount is started in step S139, and then the processing goes to step S140.

In step S140, it is determined whether the integration amount S of the reducing agent injection indication amount exceeds the threshold value S0. When it is determined that the integration amount S exceeds the threshold value S0, the processing goes to step S141, and the difference between StrtY stored in step S137 and the detected pressure value P is stored as Udvopn. Subsequently, the flag UdvopnF is put up in step S142, and then the processing is returned to step S123. Udvopn is calculated on the basis of the time at which the reducing agent injection indication amount exceeds the predetermined threshold value S0 because the pressure reduction amounts under assumed pressure-reduced states are calculated under the same condition as described above.

In step S145 executed when it is determined that the integration amount S of the reducing agent injection indication amount does not exceed the threshold value S0, it is determined whether the timer 3 is finished. When it is determined that the timer 3 is finished, the processing goes to step S141 as in the case of the determination result indicating that the integration amount S of the reducing agent injection indication amount exceeds the threshold value S0 in step S140. On the other hand, when it is determined that the timer 3 is not finished, the processing goes to step S146, and it is determined whether the system satisfies the test environment condition TE. When it is determined that the system satisfies the test environment condition TE, the processing is returned to the step S139. When it is determined that the system does not satisfy the test environment condition TE, the processing is returned to step S123. When the value of Udvopn is returned to the step S123 through the step S141, it is determined in step S129 that the flag UdvopnF is put up, and the processing goes to step S147.

In step S147, the timer 2 is actuated, and then the reducing agent injection valve is set to the full-close mode in step S148. At this time, the integration of the reducing agent injection indication amount is kept to be continued. Subsequently, in step S149, the detected pressure of the reducing agent is stored as InitC, the pump is stopped in step S150, and then the processing goes to step S151.

In step S151, the detected pressure value P of the reducing agent is compared with InitC stored in step S149 under the state that the pump is stopped, and determines whether the difference therebetween is equal to the predetermined value N3 or more. When it is determined that the difference between the detected pressure value P and InitC is equal to the predetermined value N3 or more, the processing goes to step S152. On the other hand, when it is determined that the difference concerned is less than the predetermined value N3, the processing goes to step S159, and it is determined whether the timer 2 is finished or not. When it is determined that the timer 2 is finished, the processing goes to step S152 as in the case of the determination result indicating that the difference between the pressure value P detected in step S151 and InitC is equal to the predetermined value N3 or more. On the other hand, when it is determined that the timer 2 is not finished, the processing goes to step S160. In step S160, it is determined whether the system satisfies the test environment condition TE. When the test environment condition TE is determined to be satisfied, the processing is returned to step S151. On the other hand, when the test environment condition TE is determined not to be satisfied, the processing is returned to step S123.

In step S152 executed when it is determined that the difference between the pressure value P detected in step S151 and InitC is equal to the predetermined value N3 or more or when it is determined in step S159 that the timer 2 is finished, the pressure value P of the reducing agent detected at that time is stored as StrtZ. Subsequently, the timer 3 is actuated in step S153, the integration amount S of the reducing agent injection indication amount is calculated in step S154, and then the processing goes to step S155.

In step S155, it is determined whether the integration amount S of the reducing agent injection indication amount exceeds the threshold value S0. When it is determined whether the integration amount S of the reducing agent injection indication amount exceeds the threshold value S0, the processing goes to step S156. On the other hand, when it is determined that the integration amount S does not exceed the threshold value S0, the processing goes to step S161 to determine whether the timer 3 is finished or not. When it is determined that the timer 3 is finished, the processing goes to step S156 as in the case of the determination result indicating that the integration amount S of the reducing agent injection indication amount exceeds the threshold value S0 in step S155. On the other hand, when it is determined that the timer 3 is not finished, the processing goes to step S162. In step S162, it is determined whether the system satisfies the test environment condition TE. When it is determined that the test environment condition TE is satisfied, the processing is returned to step S154. On the other hand, when it is determined that the test environment condition TE is not satisfied, the processing is returned to the step S123.

In step S156 executed when it is determined in step S155 that the integration amount S of the reducing agent injection indication amount exceeds the threshold value S0 or when it is determined in step S161 that the timer 3 is finished, the difference between StrtZ stored in step S152 and the detected pressure value P of the reducing agent is stored as Udvclo. Subsequently, the flag UdvopnF is reset in step S157, and then it is determined in step S158 whether the difference between the value of Udvclo and the value of Udvopn is equal to the clogging determining reference value D or less. When it is determined that the difference between the above two values is equal to the clogging determining reference value D or less, it is determined that the reducing agent injection valve is clogged, and TestError is indicated. On the other hand, when it is determined that the difference between the value of Udvclo and the value of Udvopn exceeds the clogging determining reference value D, it is determined that no clogging occurs in the reducing agent injection valve, the error counter is reset in step S163, and TestOK is set in step S164. When it is determined that no clogging occurs in the reducing agent injection valve, the TestOK flag is put up in step S165, and then the processing is returned to the step S123. When the processing is returned to the step S123 under this state, the pump is temporarily fully driven, and then the system is returned to the normal injection mode. Then, the processing is passed through the steps S129, S130, S131 and S132 to return the start position.

According to the clogging determining method for the reducing agent injection valve on the basis of the flowchart described above, Udvopn and Udvclo which are values reflecting the individual characteristics of the respective reducing agent supply devices are compared with each other, and thus the pressure variation amounts caused by the individual characteristics of the reducing agent supply devices can be offset with each other. Therefore, the comparison of the pressure reduction amounts caused by only the clogging degree of the reducing agent injection valve is performed, and thus the reliability of the clogging determination result can be remarkably enhanced.

The construction of the exhaust gas purification system shown in FIG. 1 is one example, and the exhaust gas purification system which can execute the clogging determining method for the reducing agent injection valve according to this invention is not limited to the exhaust gas purification system constructed as described above. For example, CAN may be omitted, or DCU and engine ECU may be constructed integrally with each other. As another example, the circulation passage provided for the purpose of the temperature control of the reducing agent may be omitted from the exhaust gas purification system.

The invention claimed is:

1. A clogging determining device for a reducing agent injection valve in an exhaust gas purification system having:

a pump for pressure-feeding reducing agent for reducing NO in exhaust gas discharged from an internal combustion engine;

a reducing agent injection valve for supplying reducing agent pressure-fed from the pump into an exhaust gas passage;

a supply passage disposed between the pump and the reducing agent injection valve;

and pressure detecting means for detecting the pressure in the supply passage, the clogging determining device comprising:

opened-valve pressure reduction amount calculating means for calculating an opened-valve pressure reduction amount representing a pressure reduction amount in the supply passage which is reduced in a predetermined time from any time point of a time of the stop of pressure feed, a time when a predetermined time elapses after the stop of the pressure feed, and a time when the pressure in the supply passage reaches a predetermined value, when the pressure-feeding operation of the pump is stopped under the state that the reducing agent injection valve is set to an injection mode;

closed-valve pressure reduction amount calculating means for calculating a closed-valve pressure reduction amount representing the pressure reduction amount in the supply passage which is reduced in a predetermined time from any time point of a time of the stop of pressure feed, a time when a predetermined time elapses after the stop of the pressure feed, and a time when the pressure in the supply passage reaches a predetermined valve, when the pressure-feeding operation of the pump is stopped under the state that the reducing agent injection valve is set to a full-close mode; and clogging determining means for comparing the opened-valve pressure reduction amount with the closed-valve pressure reduction amount to determine clogging of the reducing agent injection valve.

2. The clogging determining device for the reducing agent injection valve according to claim 1, wherein the opened-valve pressure reduction amount calculating means and the closed-valve pressure reduction calculating means determine the opened-valve pressure reduction amount or the closed-valve pressure reduction amount when the pressure-feeding operation of the pump is stopped from the state that the pump is operated so that the pressure value in the supply passage is kept to a predetermined value.

3. The clogging determining device for the reducing agent injection valve according to claim 2, wherein the exhaust gas purification system includes injection amount indicating means for indicating an injection amount of reducing agent to be injected from the reducing agent injection valve, and wherein the predetermined time when the opened-valve pressure reduction amount and the closed-valve pressure reduction amount are determined by the opened-valve pressure reduction amount calculating means and the closed-valve pressure reduction amount calculating means is determined in accordance with an injection amount of the reducing agent which is indicated by the injection amount indicating means.

4. The clogging determining device for the reducing agent injection valve according to claim 2, wherein the clogging determining means determines the clogging of the reducing agent injection valve by comparing the difference between the opened valve pressure reduction amount and the closed-valve pressure reduction amount with a predetermined clogging determining reference value.

5. The clogging determining device for the reducing agent injection valve according to claim 1, wherein the exhaust gas purification system includes injection amount indicating means for indicating an injection amount of reducing agent to be injected from the reducing agent injection valve, and wherein the predetermined time when the opened-valve pressure reduction amount and the closed-valve pressure reduction amount are determined by the opened-valve pressure reduction amount calculating means and the closed-valve pressure reduction amount calculating means is determined in accordance with an injection amount of the reducing agent which is indicated by the injection amount indicating means.

6. The clogging determining device for the reducing agent injection valve according to claim 1, wherein the clogging determining means determines the clogging of the reducing agent injection valve by comparing the difference between the opened valve pressure reduction amount and the closed-valve pressure reduction amount with a predetermined clogging determining reference value.

7. A clogging determining method for a reducing agent injection valve in an exhaust gas purification system having:

a pump for pressure-feeding reducing agent for reducing NO in exhaust gas discharged from an internal combustion engine;

a reducing agent injection valve for supplying reducing agent pressure-fed from the pump into an exhaust gas passage;

a supply passage disposed between the pump and the reducing agent injection valve; and pressure detecting means for detecting the pressure in the supply passage, the clogging determining method comprising the step of:

comparing an opened-valve pressure reduction amount representing a pressure reduction amount in the supply passage which is reduced in a predetermined time from any time point of a time of the stop of pressure feed, a time when a predetermined time elapses after the stop of the pressure feed, and a time when the pressure in the supply passage reaches a predetermined valve, when a pressure-feeding operation of the pump is stopped under a state that the reducing agent injection valve is set to an injection mode, with a closed-valve pressure reduction amount representing a pressure reduction amount in the supply passage which is reduced in a predetermined time from any time point of a time of the stop of pressure feed, a time when a predetermined time elapses after the stop of the pressure feed, and a time when the pressure in the supply passage reaches a predetermined value, when the pressure-feeding operation of the pump is stopped under a state that the reducing agent injection valve is set to a full-close mode, to determine whether the redundant injection valve is clogged or not.

8. The clogging determining method for the reducing agent injection valve according to claim 7, the clogging determining method further comprising the steps of:

pressure-feeding reducing agent by a pump so that a pressure value in the supply passage is kept to a predetermined value;

stopping the pressure-feeding operation of the pump under the state that the reducing agent injection valve is set to the injection mode and determining the opened-valve pressure reduction amount;

re-starting the pressure-feeding operation of the pump, stopping the pressure-feeding of the pump under the state that the reducing agent injection valve is set to the full-close mode after the pressure value in the supply passage reaches a predetermined value, and determining the closed-valve pressure reduction amount; and comparing the difference between the opened-valve pressure reduction amount and the closed-valve pressure reduction amount with a clogging determining reference value to determine whether the reducing agent injection valve is clogged or not.

9. The clogging determining method for the reducing agent injection valve according to claim 8, wherein the opened-valve pressure reduction amount is periodically determined under a normal operation state of an internal combustion engine, the opened-valve pressure reduction amount concerned is compared with a predetermined test start reference value, and the closed-valve pressure reduction amount is determined when the opened-valve pressure reduction amount is smaller than the test start reference value.

10. The clogging determining method for the reducing agent injection valve according to claim 9, wherein the step of determining the opened-valve pressure reduction amount and comparing the opened-valve pressure reduction amount with the test start reference value is executed at plural times, and the closed-valve pressure reduction amount is determined when the opened-valve pressure reduction amount is smaller than the test start reference value sequentially at plural times.

11. The clogging determining method for the reducing agent injection valve according to claim 7, wherein the opened-valve pressure reduction amount is periodically determined under a normal operation state of an internal combustion engine, the opened-valve pressure reduction amount concerned is compared with a predetermined test start reference value, and the closed-valve pressure reduction amount is determined when the opened-valve pressure reduction amount is smaller than the test start reference value.

12. The clogging determining method for the reducing agent injection valve according to claim 11, wherein the step of determining the opened-valve pressure reduction amount and comparing the opened-valve pressure reduction amount with the test start reference value is executed at plural times, and the closed-valve pressure reduction amount is determined when the opened-valve pressure reduction amount is smaller than the test start reference value sequentially at plural times.

* * * * *